US006801170B2

(12) United States Patent
Forrester et al.

(10) Patent No.: US 6,801,170 B2
(45) Date of Patent: Oct. 5, 2004

(54) SYSTEM AND METHOD FOR PROVIDING A QUASI-ISOTROPIC ANTENNA

(75) Inventors: Tim Forrester, San Diego, CA (US); Robert Bruce Ganton, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 0 days.

(21) Appl. No.: 10/227,036

(22) Filed: Aug. 23, 2002

(65) Prior Publication Data

US 2003/0076262 A1 Apr. 24, 2003

Related U.S. Application Data

(63) Continuation-in-part of application No. 09/881,611, filed on Jun. 14, 2001, now Pat. No. 6,441,790.

(51) Int. Cl.[7] ..... H01Q 1/38; H01Q 1/24

(52) U.S. Cl. ..... 343/702; 343/700 MS

(58) Field of Search ..... 343/702, 700 MS, 343/846, 850, 720, 905; 455/89, 90, 269, 301

(56) References Cited

U.S. PATENT DOCUMENTS

| | | | | |
|---|---|---|---|---|
| 5,678,216 | A * | 10/1997 | Matai | 455/269 |
| 6,204,819 | B1 * | 3/2001 | Hayes et al. | 343/702 |
| 6,441,790 | B1 * | 8/2002 | Forrester et al. | 343/702 |
| 6,476,769 | B1 * | 11/2002 | Lehtola | 343/702 |
| 6,509,882 | B2 * | 1/2003 | McKivergan | 343/818 |
| 6,535,166 | B1 * | 3/2003 | Ali | 343/700 MS |

* cited by examiner

*Primary Examiner*—James Vannucci

(57) ABSTRACT

A system and method for wireless communications includes a wireless communications device. The wireless communications device includes a microstrip, line or trace that has been structured to electrically connect to electrical circuitry and electrical components of the wireless communications device and has been adapted to transmit and to receive wirelessly a short-range wireless communications signal. The microstrip, line or trace is formed from branches of conducting material. One or more of the branches may include a specific absorption rate element, such as a specific absorption rate bracket.

36 Claims, 5 Drawing Sheets

SYSTEM AND METHOD FOR PROVIDING A QUASI-ISOTROPIC ANTENNA

This application is a Continuation in Part of patent application Ser. No. 09/881,611 filed Jan. 14, 2001 now U.S. Pat. No. 6,441,790.

FIELD OF THE INVENTION

The present invention generally relates to a system and a method for providing an antenna and, more specifically, to a system and a method for providing a quasi-isotropic antenna.

BACKGROUND OF THE INVENTION

In an increasingly mobile working environment, short-range communications standards were developed to help in eliminating wires and cables between stationary devices, mobile devices and combinations thereof. Examples of short-range communications standards include, for example, IEEE 802.11 and HyperLan. Another example of a short-range communications standard is the global standard called Bluetooth. Bluetooth is a relatively short-ranged wireless technology that has found application in ranges under approximately 100 yards and has proven popular in providing personal area networks (PANs) located in homes and small offices. Unlike other conventional wireless techniques such as infrared (e.g., IrDA), Bluetooth does not require a direct line of sight for communications. In addition, Bluetooth can provide, for example, point-to-point and/or point-to-multipoint connections in piconet and scatternet configurations.

Bluetooth generally includes hardware components, software and interoperability requirements. Bluetooth hardware includes a 2.4 GHz Bluetooth radio and provides spread spectrum techniques such as frequency hopping. For example, Bluetooth may operate in a 2.4 GHz to 2.48 GHz range in which signal hops may occur among 79 frequencies at 1 MHz intervals. Furthermore, at present, Bluetooth can support voice channels, for example, of 64 kb/s and asynchronous data channels of, for example, 723.2 kb/s asymmetric or 433.9 kb/s symmetric.

In theory, Bluetooth technology can be installed in handheld wireless communications devices such as, for example, cellular phones or personal digital assistants (PDAs). For example, a Bluetooth antenna can be mounted on a handheld device in addition to the cellular antenna. However, in general, Bluetooth technology tends to interfere with the cellular transceivers including cellular antennas. Furthermore, the converse is true that cellular transceivers including cellular antennas tend to interfere with Bluetooth technology. Accordingly, neither the Bluetooth antenna nor the cellular antenna works effectively.

In another conventional device, a Bluetooth patch antenna is placed on the back of the cellular phone with additional shielding between the Bluetooth antenna and the back of the cellular phone. However, such a device performs poorly if, for example, the cellular phone is disposed on its back while lying on a table. In this position, the shielding and the table block effective communications with the Bluetooth antenna.

The consequences become exacerbated in situations in which the Bluetooth technology is used for automated communications. For example, the Bluetooth technology may be configured to transfer e-mail messages from a local wireless network in an office to a handheld device carried by the user when the user is in Bluetooth range (e.g., in the office) of the local wireless network. If the user places the handheld device in such an orientation as to effectively shield the Bluetooth antenna from the local wireless network (despite being in range of the local wireless network), then the e-mail messages will not be transferred to the handheld device, the user will be unaware of communications problems and the user will assume that he or she had no unread e-mail messages on the local wireless network.

SUMMARY OF THE INVENTION

The short-range wireless antennas in known wireless communications devices do not perform well. Specifically, the known wireless antennas have anisotropic radiation patterns. This results in failed short-range wireless communications when the wireless communication device is orientated in certain positions. There exists a need to provide a short-range wireless antenna in a wireless communications device in which the short-range wireless antenna has quasi-isotropic radiation characteristics.

Briefly, the present invention uses a microstrip, line or trace forming part of the wireless communications device's electrical circuitry to function as a short-range wireless antenna. The microstrip, line or trace is structured to transmit and receive short-range communications signals. The structure of the microstrip, line or trace includes many branches that meander in a plurality of directions to provide the antenna with quasi-isotropic radiation characteristics.

Advantages of the present invention include forming a short-range wireless antenna in a wireless communications device by using an existing microstrip, line or trace. The present invention also has an advantage in that existing shielding may provide isolation between the existing antenna and the microstrip, line or trace that has been adapted to be a short-range antenna. Therefore, a separate short-range antenna and additional shielding is not needed which results in cost reduction and space savings in an already crowded circuit board of the wireless communications device.

An additional advantage is that the meandering line shape of the microstrip, line or trace provides an antenna with quasi-isotropic radiation characteristics. Such quasi-isotropic radiation characteristics are further enhanced in configurations in which the microstrip, line or trace is disposed on the front side and the rear side of a printed circuit board of the wireless communications device, or meanders away from the board in a vertical direction. Furthermore, the microstrip, line or trace may operate as a specific absorption rate element that redirects radiation away from the back of the wireless device and the user.

These and other features and advantages of the present invention will be appreciated by reviewing the following detailed description of the present invention and the accompanying figures.

DETAILED DESCRIPTION OF THE INVENTION

Figure 1:
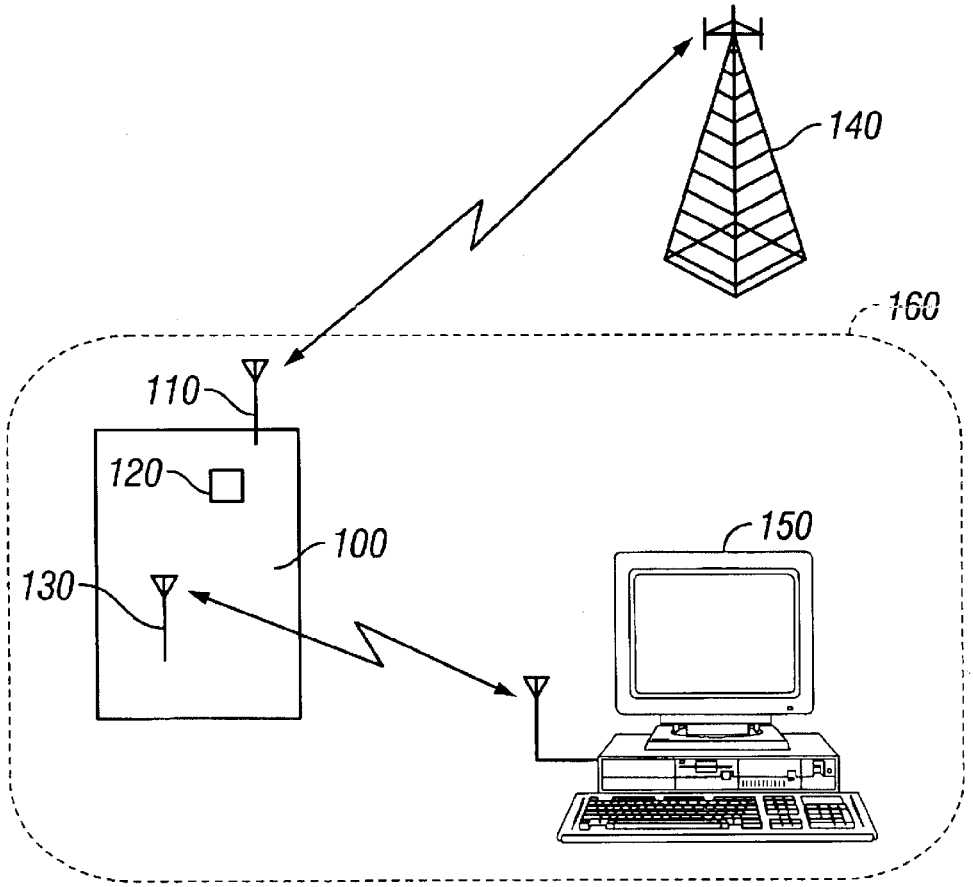
FIG. 1 is a schematic representation illustrating an exemplary embodiment of a wireless communications device according to the present invention.

FIG. 1 illustrates an exemplary embodiment of a wireless communications device 100 according to the present invention. The wireless communications device 100 may include, for example, a handheld wireless communications device, a mobile phone, a car phone, a cellular or a personal communications services (PCS) phone, a cordless phone, a laptop computer or other computing device with a wireless modem, a pager or a personal digital assistant (PDA). The wireless device 100 may be digital or analog or some combination thereof. Indeed, the present invention contemplates other forms of wireless communications devices known to one of ordinary skill in the art.

As illustrated in FIG. 1, the wireless communications device 100 includes a first antenna 110, shielding 120 and a second antenna 130. In an exemplary embodiment, the wireless communications device 100 is a cellular phone; the first antenna 110 is code division multiple access (CDMA) antenna; the second antenna 130 includes a short-range antenna (e.g., a Bluetooth antenna or other short-range communications antennas) in accordance with the present invention. The shielding 120 provides isolation between, for example, the Bluetooth antenna 130 and the CDMA antenna 110.

The first antenna 110 is in two-way wireless communications with a base station 140. The base station 140 may be part of, for example, an array of base stations 140 or cells which are part of a wireless communications network (e.g., a CDMA cellular network). The second antenna 130 may be in two-way communications with a short-range wireless communications network 150 when the wireless communications device 100 is within a range area 160 of the short-range wireless communications network 150.

In operation, a user may access the base station 140 via the first antenna 110. Thus, for example, the user may make a wireless CDMA telephone call using the first antenna 110 of the wireless communications device 100. Furthermore, if the user enters the range area 160 of the short-range wireless communications network 150, then the second antenna 130 may be used to automatically and seamlessly establish two-way communications with the short-range communications network 150.

In an exemplary embodiment, the short-range wireless communications network 150 includes or is part of an office network which may include devices or networks coupled by short-range wireless communications (e.g., using Bluetooth technology) or devices coupled by, for example, local area networks via cables. When the user enters the range area 160 (e.g., the office building), the wireless communications device 100 and the office network 150 automatically and seamlessly establish two-way communications. Thus, for example, the user may print out a hardcopy of an e-mail, that has been loaded onto the wireless communications device 100, to a printing device that is coupled to or a part of the office network 150. In another example, the user may wirelessly access the Internet via the office network 150, which itself is connected to the Internet via, for example, a cable modem. The user may use the wireless communications device 100 to call or to interact with others devices or users that are coupled to or part of the office network 150. Conversely, devices or users that are coupled to or part of the office network 150 may call or interact with the wireless communications device 100.

Furthermore, information transfers between the wireless communications device 100 and the office network 150 can be automatic and seamless. This is particularly advantageous where, in the range area 160, the device 100 and the office network 150 automatically locate and interact with each other. For example, when the wireless communications device 100 enters the range area 160 of the office network 150, the office network 150 is notified that the wireless communications device 100 is within the range area 160 and automatically transmits unread e-mails to the wireless communications device 100 via the second antenna 130. The wireless communications device 100 and the office network 150 can automatically synchronize information stored in the device 100 and the office network 150. Thus, updates made to, for example, the calendar or other databases of the user stored in the wireless communications device 100 may be transferred to the calendar or other databases of the user stored in the office network 150. In another example, files or information updated on the office network 150 can be transferred to the wireless communications device 100 to update the files or information stored in the wireless communications device 100.

Figure 2:
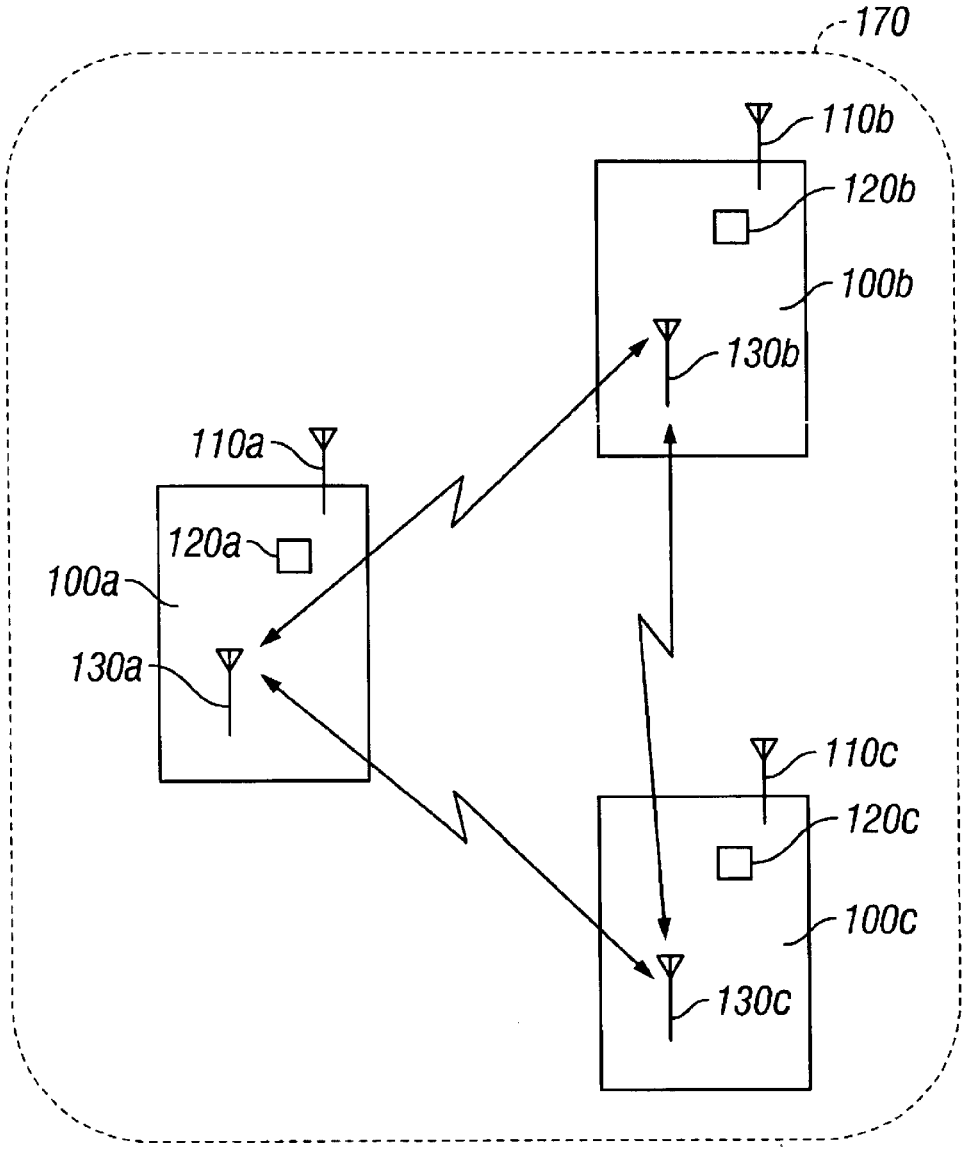
FIG. 2 is a schematic representation illustrating a plurality of wireless communications devices communicating using short-range antennas according to the present invention.

FIG. 2 illustrates three wireless communications devices 100*a–c*, which are in wireless communications via second antennas 130*a–c*. Although the wireless communications devices 100*a–c* can be coupled via a short range wireless network 150 (e.g., an office network) (FIG. 1), the wireless communications devices 100*a–c* can be coupled directly or form a short-range wireless network themselves. In an exemplary embodiment, the first wireless communications device 100*a* is in direct and simultaneous two-way communications with the second wireless communications device 100*b* and the third wireless communications device 100*c*. Accordingly, the second wireless communications device 100*b* and the third wireless communications device 100*c* are in direct two-way communications with each other, or are in two-way communications via the first wireless communications device 100*a*. The present invention contemplates other numbers of wireless communications devices 100 in two-way communications directly or indirectly. Furthermore, the present invention also provides that other devices or networks can be coupled to this ad hoc network 170 by coupling (e.g., wirelessly coupling) with any of the three wireless communications devices 100*a–c*.

Figure 3A:
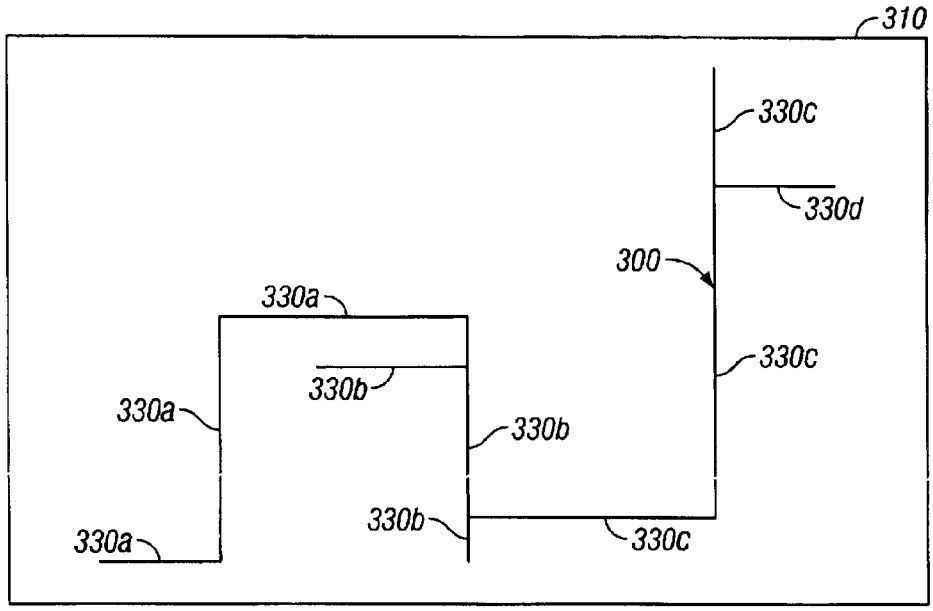
FIG. 3A is a schematic representation illustrating an exemplary embodiment of a trace according to the present invention.
Figure 3B:
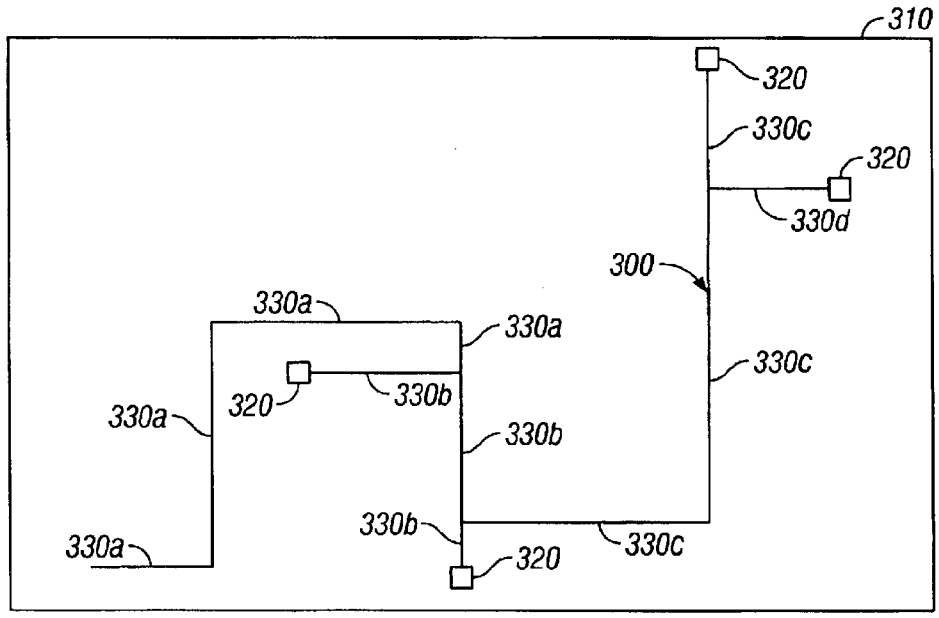
FIG. 3B is a schematic representation illustrating the trace shown in FIG. 3A coupled to other circuitry according to the present invention.

FIGS. 3A and 3B are schematic representations illustrating a trace 300 disposed on a printed circuit board (PCB) 310. It will be appreciated that a microstrip or line may be substituted for the trace 300. The trace 300 may be disposed on a plurality of sides and edges of the PCB 310. Thus, for example, the trace 300 may be disposed on a front side and a back side of the PCB 310. The trace 300 is illustrated as meandering in a plurality of directions with numerous branches. Furthermore, the trace 300 is spread substantially throughout the PCB 310.

FIG. 3B shows the trace 300 connected to electrical components and electrical circuitry 320 of the wireless communications device 100 (FIGS. 1 and 2). It will be appreciated that a microstrip or line may be substituted for the trace 300. For example, the trace 300 may be a signal trace, power trace or ground line. The trace 300 may be disposed on a plurality of sides or edges of the printed circuit board 310. Thus, for example, the trace 300 may be disposed on a front side and a back side of the printed circuit board 310. The trace 300 is illustrated as meandering in a plurality of directions with numerous branches 330*a–d*. The branches 330*a–d* are electrically connected together to form the trace 300. The trace 300 may use any conducting material present on the printed circuit board 310.

The trace 300 is typically a data line or signal line that forms part of the wireless communications device's electrical circuitry. The electrical components and circuitry 320 form signal sources and signal sinks. In operation, the electrical components and circuitry 320 drive and receive signals on trace 300 via branches 330*a–d*. For example, the electrical components and circuitry 320 may drive a power signal on the trace 300. Alternatively, the electrical components and circuitry 320 may drive data and control signals on the trace 300.

Furthermore, the trace 300 may be a ground line electrically connecting the electrical control and circuitry 320 to a ground plane. When the trace 300 is connected to a ground plane, the trace 300 provides a common return path for electromagnetic signals forming a part of the wireless device's electrical control and circuitry 320. In this manner, the trace 300 carries signals essential to the operation of the wireless communications device 100 (FIGS. 1 and 2).

Figure 3C:
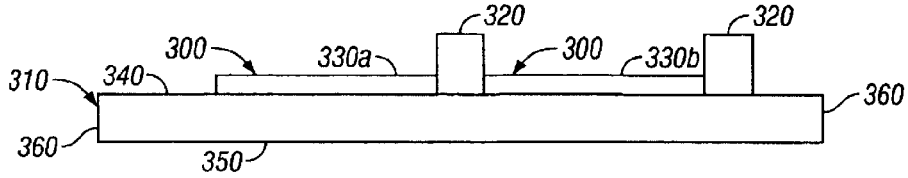
FIG. 3C is a physical representation illustrating a side view of the trace shown in FIG. 3B coupled to other circuitry according to the present invention.

FIG. 3C is a physical depiction showing a side view of the trace 300 disposed on the printed circuit board 310. The trace 300 and electrical components and circuitry 320 are disposed on a front side 340 of the printed circuit board 310. However, trace 300 and electrical components and circuitry 320 may be disposed on a back side 350 or edges 360 of the printed circuit board 310. The electrical components and circuitry 320 are electrically connected through the trace 300. The branches 330*a* and 330*b* of the trace 300 are electrically connected together forming the trace 300.

Figure 3D:
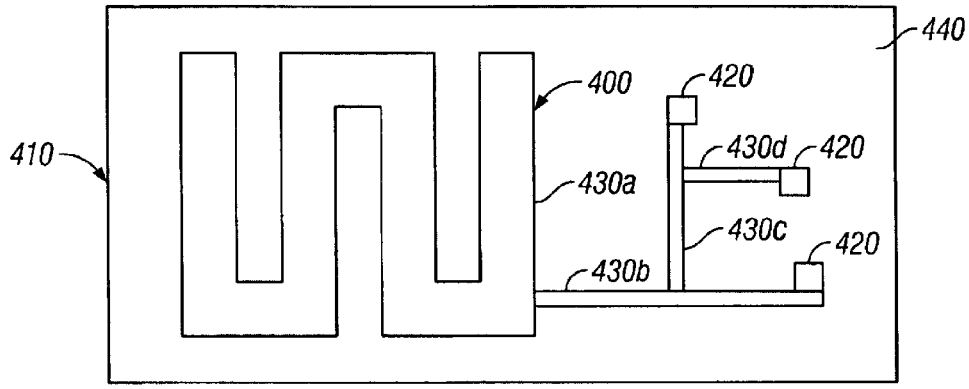
FIG. 3D is a physical representation illustrating a top-down view of an exemplary embodiment of a trace according to the present invention.

FIG. 3D is a physical depiction showing an embodiment of the trace 400 in which one branch 430*a* of the trace 400 is a specific absorption rate (SAR) element. The SAR element branch 430*a* is disposed on the front side 440 of printed circuit board 410 and is electrically connected to the electrical components and circuitry 420 and other branches 430*b–d* of the trace 400. The SAR element branch 430*a* redirects electromagnetic signals away from the wireless communication device 110 (FIGS. 1 and 2) and away from a user. It will be appreciated that the SAR element branch 430*a* may lie flatly against the front surface 440 of the printed circuit board 410. The SAR element branch 430*a* may also extend away from the printed circuit board 410. It will also be appreciated that more than one branch 430*a–d* may form an SAR element in the wireless communications device 110 (FIGS. 1 and 2). Furthermore, the SAR element branch 430*a* may extend to other conductive elements of the wireless communications device 10, such as the shielding 120 (FIGS. 1 and 2).

Figure 3E:
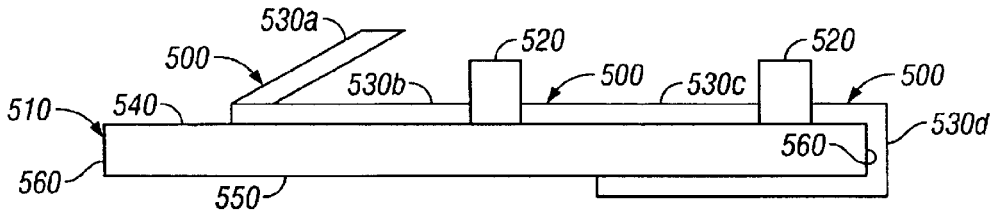
FIG. 3E is a physical representation illustrating a side view of an exemplary embodiment of a trace according to the present invention.

FIG. 3E illustrates another embodiment of the trace 500 in which the SAR element branch 530*a* is an extension of the trace 500 and extends in a vertical direction away from the printed circuit board 510. For example, the SAR element branch may be a specific absorption rate bracket. Typically, the SAR element branch 530*a* of the trace 500 is spaced away from other electrical components and circuitry 520 on the printed circuit board 510. The trace 500 and electrical components and circuitry 520 are disposed on a front side 540, back side 550 and edges 560 of the printed circuit board 510. The electrical components and circuitry 520 are electrically connected through the branches 530*a–d* of the trace 500. The vertically extending SAR element branch 530*a* is mounted to branch 530*b* and electrically coupled to branches 530*b–d* forming the trace 500. The vertically extending SAR element branch 530*a* may use any conducting material present on the printed circuit board 510. The SAR element branch 530*a* and other branches 530*b*, 530*c* and 530*d* form part of the wireless communications device's 100 (FIGS. 1 and 2) electrical circuitry.

In this manner, the trace 500 operates both as an additional short-range antenna and as an SAR element. A separate short-range antenna or additional SAR element is not needed resulting in cost and space savings in the wireless communications device 100 (FIGS. 1 and 2).

Figure 4:
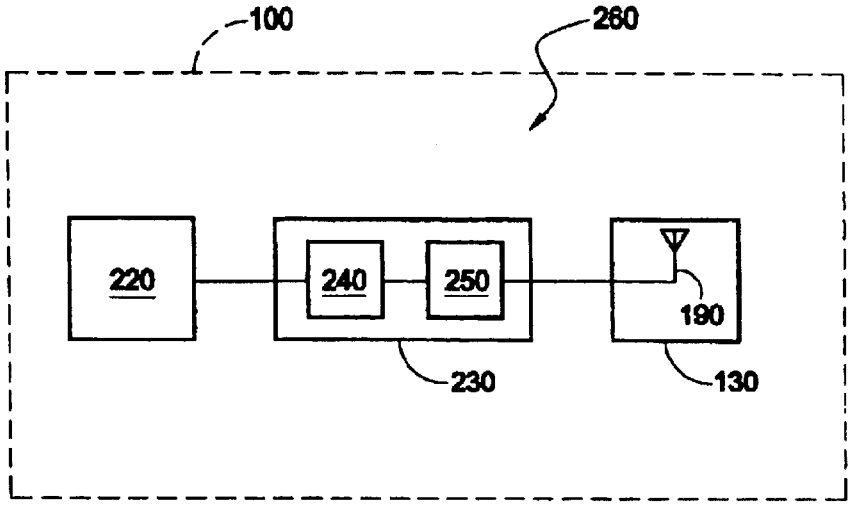
FIG. 4 is a block representation illustrating a short-range wireless communications transceiver according to the present invention.

FIG. 4 is a block representation of the wireless communications device 100 including a short-range radio transceiver 260 according to the present invention. The short-range radio transceiver 260 includes a radio-frequency integrated circuit (RFIC) 220, a compensation module 230 and the second antenna 130. The compensation module 230 also includes an optional matching impedance module 240 and a tuning module 250. The second antenna 130 includes a microstrip, line or trace 190. For example, the microstrip, line or trace 130 may be a power microstrip, signal trace, ground signal trace, signal line or ground line.

As illustrated, the RFIC 220 is connected to the matching impedance module 240 which, in turn, is connected to the tuning module 250. The tuning module 250 is connected to the microstrip, line or trace 190. In operation, the RFIC 220 transmits to or receives from the second antenna 130 a signal that has been tuned and possibly impedance matched by the compensation module 230.

In an exemplary embodiment, the RFIC 220 includes conventional Bluetooth technology including corresponding hardware, software and combinations thereof. The compensation module 230 includes an optional matching impedance module 240 which matches an impedance of the RFIC 220 as seen from the impedance module 240 to an impedance of the second antenna 130 as seen from the impedance module 240. The matched impedance may be a particular value having real or imaginary values. In an exemplary embodiment, the matched impedance value is the impedance of the RFIC 220 which is, for example, approximately 50 Ω, approximately 75 Ω or other impedance values.

Figure 5:
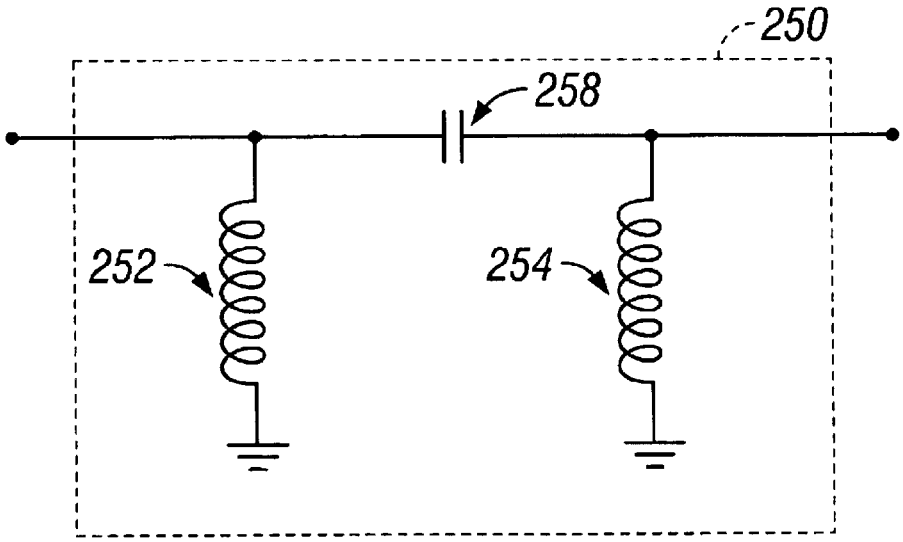
FIG. 5 is a circuit representation of an embodiment of a tuning module according to the present invention.

The compensation module 230 also may include a tuning module 250. The tuning module 250 may compensate for non-linear responses of the second antenna 130. For example, the tuning module 250 may be a tuning circuit that compensates for frequency dependent impedance variations. FIG. 5 illustrates an embodiment of the tuning module 250, which includes inductors 252, 254 and capacitor 258 in a particular tuning configuration according to the present invention. Clearly, the present invention contemplates other more complex tuning arrangements and their dual equivalents and may include passive elements, active elements or some combination thereof. Such tuning arrangements, configurations and their dual equivalents would be available without undue experimentation to one of ordinary skill in the art.

In an exemplary embodiment, the present invention implements a lossy transmission line approach. The microstrip, line or trace 190 is adapted to provide an antenna that is electrically long and convoluted which tends to promote a quasi-isotropic radiation pattern. Although not well suited for cellular use due to its lossy nature, the microstrip, line or trace 190, by optimizing the loss, may act as a low gain antenna, which finds application in, for example, Bluetooth technology.

By using the microstrip, line or trace 190 as a short-range radio frequency antenna (e.g., a Bluetooth antenna), the present invention accrues a number of advantages. For example, since the microstrip, line or trace 190 meanders throughout the PCB 180 in numerous directions and may be present on a front and a back side of the PCB 180, the microstrip, line or trace 190, when used, for example, as a Bluetooth antenna, has quasi-isotropic radiation characteristics. Therefore, because of the approximately omni-directional coverage, there is an enhanced probability that no matter what position and orientation the user places the wireless communications device 100, the Bluetooth antenna will be able to have or to maintain two-way communications with, for example, the office network 150 when within the range area 160.

Furthermore, since the present invention employs the microstrip, line or trace 190 in the wireless communications device 100, no additional antenna is needed. An additional advantage of the present invention is that an existing shielding 120, which normally isolates the first antenna (e.g., the CDMA antenna) 110 from the microstrip, line or trace 190, can be employed to isolate the first antenna 110 from the second antenna 130 (e.g., the Bluetooth antenna). In an exemplary embodiment, by using the existing shielding 120 and adapting the existing microstrip, line or trace 190 as described above for use in the second antenna 130, the present invention minimizes the number of additional parts which are added to the wireless communications device 100 and, in particular, to the PCB 180.

Thus, it is seen that a system and method for wireless communications are provided. One skilled in the art will appreciate that the present invention can be practiced by other than the preferred embodiments which are presented in this description for purposes of illustration and not of limitation, and the present invention is limited only by the claims that follow. It is noted that equivalents for the particular embodiments discussed in this description may practice the present invention as well.

What is claimed is:

1. A wireless communications device, comprising:

a printed circuit board including electrical components;

a short-range communications antenna formed by the arrangement of a trace for the printed circuit board;

a cellular phone antenna; and wherein the trace is adapted to provide signals to the electrical components of the printed circuit board.

2. The wireless communications device according to claim 1, further comprising:

a shield isolating the cellular phone antenna from signal noise generated by signals carried by the trace and from short-range communications signals transmitted or received by the trace.

3. The wireless communications device according to claim 1, wherein the short-range communications antenna is a Bluetooth antenna.

4. The wireless communications device according to claim 1, wherein the trace is a signal trace.

5. The wireless communications device according to claim 1, wherein the trace is connected to a ground plane.

6. The wireless communications device according to claim 1, wherein the trace further comprises branches electrically connected to each other and composed of conducting material.

7. The wireless communications device according to claim 6, wherein the short-range communications antenna comprises a specific absorption rate element forming part of the wireless device's electrical circuitry.

8. The wireless communications device according to claim 7, wherein the specific absorption rate element is formed from the same conducting material as other branches comprising the trace.

9. The wireless communications device according to claim 8, wherein the specific absorption rate element is a specific absorption rate bracket.

10. A wireless communications device, comprising:

a printed circuit board including electrical components;

a short-range communications antenna comprising a trace for the printed circuit board;

a cellular phone antenna; and wherein the trace is adapted to provide signals to the electrical components of the printed circuit board, the trace being connected to a specific absorption rate bracket;

and wherein the short-range communications antenna comprises the specific absorption rate bracket.

11. A wireless communications device, comprising:

a printed circuit board including electrical elements;

a radio-frequency integrated circuit (RFIC) disposed on the printed circuit board;

a compensation module coupled to the RFIC and including a tuning circuit;

a trace disposed on at least one side of the printed circuit board and coupled to the compensation module, the trace providing a signal to the electrical elements of the printed circuit board, the trace being a short-range radio antenna, wherein the tuning circuit compensates for non-linear responses of the short-range radio antenna to radio-frequency signals; and a cellular antenna.

12. The wireless communications device according to claim 11, wherein the non-linear responses include frequency dependent impedance variations.

13. The wireless communications device according to claim 11, wherein the trace is disposed in a meandering pattern on at least one side of the printed circuit board.

14. The wireless communications device according to claim 11, wherein the short-range radio antenna is a Bluetooth antenna.

15. The wireless communications device according to claim 11, further comprising: a shield isolating the cellular antenna from signal noise generated by signals carried by the trace and from Bluetooth signals transmitted or received by the trace.

16. The wireless communications device according to claim 15, wherein the shield isolates the Bluetooth antenna from cellular signals received or transmitted by the cellular antenna.

17. The wireless communications device according to claim 11, wherein the trace further comprises branches electrically connected to each other and composed of conducting material.

18. The wireless communications device according to claim 17, wherein at least one of the branches is a specific absorption rate element.

19. The wireless communications device according to claim 18, wherein the specific absorption rate element is a specific absorption rate bracket.

20. The wireless communications device according to claim 11, wherein the compensation module includes an impedance matching module disposed between radio-frequency integrated circuit and the trace.

21. The wireless communications device according to claim 11, wherein the impedance matching module matches an impedance of the radio-frequency integrated circuit as seen from the impedance matching module to an impedance of the short-range radio antenna as seen from the impedance matching module.

22. A short-range wireless communications device, comprising:

electrical components;

a trace adapted to be a short-range antenna and structured to provide signals to the electrical components; and a printed circuit board on which the electrical components are mounted and on which the trace is arranged.

23. The device according to claim 22, wherein the trace is adapted to be a quasi-isotropic antenna.

24. The device according to claim 22, wherein the trace is adapted to be a Bluetooth antenna.

25. The device according to claim 22, further comprising: an electrical ground plane connected to the trace and providing a ground potential to the electrical components via the trace.

26. The device according to claim 22, further comprising: a signal source connected to the trace and providing electrical signals to the electrical components via the trace.

27. The device according to claim 22, wherein the printed circuit board has a front side and a rear side, the trace being disposed on both the front side and the rear side of the printed circuit board.

28. The device according to claim 22, wherein the trace is disposed in a convoluted pattern on at least one side of the printed circuit board.

29. The device according to claim 22, wherein the trace is disposed in a meandering pattern on at least one side of the printed circuit board.

30. The device according to claim 22, wherein the trace meanders across at least two sides of the printed circuit board.

31. The wireless communications device according to claim 22, wherein the trace further comprises branches formed of conducting material.

32. The wireless communication device of claim 31, wherein at least one of the branches is a specific absorption rate element.

33. The wireless communication device of claim 32, wherein the specific absorption rate element is a specific absorption rate bracket.

34. A method for adapting a trace to be a Bluetooth antenna in a handheld wireless communications device, comprising the steps of:

providing a printed circuit board adapted for electrical connection to a cellular antenna and to electrical components;

printing the trace in a meandering pattern on the printed circuit board of the handheld wireless communications device, wherein the trace provides signals to the electrical components and acts as a short-range communications antenna;

providing a specific absorption rate element, wherein the specific absorption rate element is electrically connected to the trace;

impedance matching the trace with a Bluetooth integrated circuit;

compensating for non-linear responses of the microstrip to Bluetooth signals with a tuning circuit; and using the trace and the specific absorption rate element as a Bluetooth short-range antenna.

35. The method according to claim 34, wherein the step of printing includes the step of printing the trace on at least two sides of the printed circuit board.

36. The method according to claim 34, wherein the step of compensating for non-linear response includes the step of compensating for frequency dependent impedance variations.

* * * * *